United States Patent [19]

Madore et al.

[11] Patent Number: 4,973,260

[45] Date of Patent: Nov. 27, 1990

[54] CONNECTOR FOR INTERCONNECTION OF PRINTED CIRCUIT BOARDS

[75] Inventors: Daniel W. Madore, Flemington; Gregory Fishbein, Piscataway, both of N.J.

[73] Assignee: Thomas & Betts Corporation, Bridgewater, N.J.

[21] Appl. No.: 400,250

[22] Filed: Aug. 29, 1989

[51] Int. Cl.[5] ..... H01R 13/652

[52] U.S. Cl. ..... 439/101; 439/65

[58] Field of Search ..... 439/65, 78, 82, 92, 439/95, 101, 108, 607, 609, 610

[56] References Cited

U.S. PATENT DOCUMENTS

| | | | |
|---|---|---|---|
| 3,149,893 | 9/1964 | Dupre | 439/607 |
| 3,526,869 | 9/1970 | Conrad et al. | 339/75 |
| 3,530,422 | 9/1970 | Goodman | 339/17 |
| 4,080,027 | 3/1978 | Benasutti | 339/17 |
| 4,134,632 | 1/1979 | Lindberg et al. | 339/17 |
| 4,265,506 | 5/1981 | Hollyday | 339/147 |
| 4,392,705 | 7/1983 | Andrews, Jr. et al. | 339/75 MP |
| 4,451,107 | 5/1984 | Dola et al. | 339/143 |
| 4,494,818 | 1/1985 | Petersen et al. | 339/192 |
| 4,506,937 | 3/1985 | Cosmos et al. | 339/14 |
| 4,512,618 | 4/1985 | Kumar | 339/14 |
| 4,521,062 | 6/1985 | Kurbikoff et al. | 339/14 |
| 4,533,203 | 8/1985 | Feldman et al. | 339/176 |
| 4,585,292 | 4/1986 | Frantz et al. | 339/143 |
| 4,655,518 | 4/1987 | Johnson et al. | 339/17 |
| 4,687,263 | 8/1987 | Cosmos et al. | 439/108 |
| 4,869,676 | 9/1989 | Demler, Jr. et al. | 439/101 |

FOREIGN PATENT DOCUMENTS

| | | | |
|---|---|---|---|
| 2517482 | 11/1981 | France | 339/143 |

*Primary Examiner*—Eugene F. Desmond

*Attorney, Agent, or Firm*—Robert M. Rodrick; Salvatore J. Abbruzzese

[57] ABSTRACT

An electrical connector for interconnecting printed circuit boards with signal and grounding contacts has a housing including a base defining signal contact seating passages therethrough, a sidewall adjacent the base and including successive first and second sidewall portions of respective different thickness, the second sidewall portions defining with the base a plurality of channels each for the receipt of a grounding contact member, the base including a portion in spaced facing relation to each of the second sidewall portions. The base and each base portion have adjacent surface portions with mutually different attitudes preselected to match the respective different attitudes of sections of a grounding contact member to be inserted in each of the channels.

7 Claims, 4 Drawing Sheets

CONNECTOR FOR INTERCONNECTION OF PRINTED CIRCUIT BOARDS

FIELD OF THE INVENTION

This invention relates generally to electrical connectors and housings therefor and pertains more particularly to electrical connectors for the interconnection of printed circuit boards of so-called "backplane" and "daughter" board types.

BACKGROUND OF THE INVENTION

It is typical in data processing apparatus for implementing a system in printed circuit board (PCB) format, wherein space and other constraints call for accessory PCBs (daughter boards) to be disposed in orthogonal relation to principal PCBs (backplane boards). Connectors are required for electrically interconnecting the respective electrically conductive traces on the daughter boards and backplane boards, and include matable connector housings having contact sets permanently engaged with electrically conductive traces on the respective PCBs. The contact sets are mated with one another on mating of the connector housings. One such known connector is described in U.S. Pat. No. 4,655,518.

The '518 patent is seen as disclosing a connector for interconnecting first and second printed circuit boards, comprising a first housing of electrically insulative material including a base and opposed sidewalls defining a contact disposition area therebetween. A first contact set is supported in the first housing contact disposition area and is inclusive of a grounding contact disposed adjacent one of the sidewalls and carried thereby and signal contacts disposed in the base between the grounding contact and the other of the sidewalls. A second housing of electrically insulative material has a configuration complemental with the configuration of the first housing to be matable therewith and a second contact set is supported in the second housing including signal contacts engageable with the signal contacts of the first contact set upon mating of the first and second housings and a grounding contact again supported by the second housing sidewall and engaging the ground contacts of the first contact set upon mating of the first and second housings.

Of significance, expressed in the '518 patent, is that the ground contacts do not appreciably cause an increased crosswise dimension of the first and second connector housings, since such ground contacts are carried by the housing sidewalls and do not require additional PCB "real estate" above that required by the signal contacts. Further, the '518 patent sees as a matter of consequence that the contact disposition area of the first connector housing be free of the presence of connector housing electrically insulative material.

On the other hand, British Pat. No. 580,216 expressly shows the use of discrete slidingly engageable contact elements carried outwardly of an insulative body which further supports diverse other pin-socket contact elements, respectively for signal and ground interconnect.

SUMMARY OF THE INVENTION

The present invention has as its primary object the provision of improved connectors for effecting the electrical interconnection of printed circuit boards.

In the attainment of the foregoing and other objects, the invention provides an electrical connector for interconnecting printed circuit boards with signal and grounding contacts having a housing including a base defining signal contact seating passages therethrough, a sidewall adjacent the base and including successive first and second sidewall portions of respective different thickness, the second sidewall portions defining with the base a plurality of channels each for the receipt of a grounding contact member, the base including a portion in spaced facing relation to each of the second sidewall portions. The base and each base portion have adjacent surface portions with mutually different attitudes preselected to match the respective different attitudes of sections of a grounding contact member to be inserted in each of the channels.

More particularly, the present invention provides a connector for interconnecting first and second printed circuit boards, comprising a first housing of electrically insulative material including a base and opposed sidewalls defining a contact disposition area therebetween.

A first contact set is supported in the first housing contact disposition area, inclusive of a grounding contact member disposed adjacent one of the sidewalls and signal contacts disposed between the grounding contact member and the other of the sidewalls.

A portion of the base extends in juxtaposition with the grounding contact member and is disposed between the grounding contact member and the signal contacts in the contact disposition area, the base thereby supporting the grounding contact member.

A second housing of electrically insulative material has configuration complemental with the configuration of the first housing to be matable therewith, and includes a second contact set supported in the second housing including signal contacts engageable with the signal contacts of the first contact set upon mating of the first and second housings and a grounding contact member engageable with the grounding contact member of the first contact set upon mating of the first and second housings.

The foregoing and other objects and features of the invention will be further understood from the following detailed discussion of preferred embodiments thereof and from the drawings wherein like components are identified by like reference numerals throughout.

DETAILED DESCRIPTION OF THE PREFERRED EMBODIMENT AND PRACTICE

Figure 1:
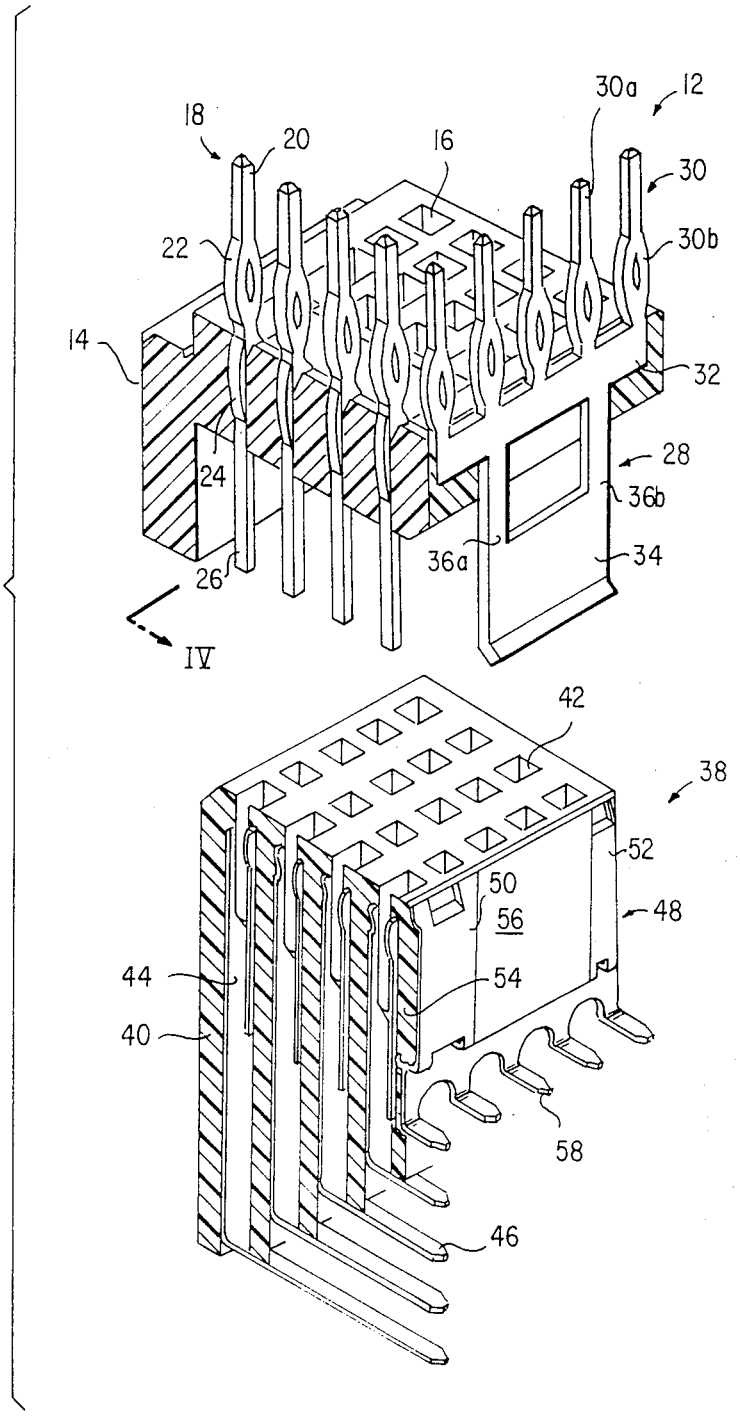
FIG. 1 is an exploded view in perspective of a connector generally configured in accordance with the present invention.

Referring to FIG. 1, connector assembly 10 includes upper connector 12, having electrically insulative housing 14 defining contact seating passages 16 therethrough. Contacts 18 are signal contacts, each inclusive of an upper pin 20, first and second compliant sections 22 and 24 and a lower pin 26. Grounding contact member 28 has ground contacts 30, each including an upper pin 30*a*, a single compliant section 30*b*, a shunt portion 32 nested in the housing as discussed below and electrically commoning all of contacts 30, and a lower contact 34 connected to shunt portion 32 by legs 36*a* and 36*b*. For solder installations, the contact configuration for contacts 18 would be modified by omission of compliant section 22 and by replacing section 24 by a swaged configuration, while the contact configuration for grounding contact member 28 will have compliant secion 30*b* omitted.

Connector assembly 10 further includes lower connector 38, having electrically insulative housing 40 defining contact seating passages 42. Contacts 44 are configured as female contacts and are retentively resident in passages 42 and include connecting pins 46 extending outwardly of housing 40. Grounding contact member 48 has locking ears 50 and 52 engaged with housing 40 outer wall 54 and includes a central expanse 56 configured to engage grounding contact member 34 of connector 12. Pins 58 of grounding contact member 48 extend outwardly with pins 46.

Contacts 18 and 30 are inserted in a first PCB (not shown) and press fit in place to be electrically connected with conductive circuit traces of the first PCB. In the case of the alternate contact configuration above discussed, the contacts are soldered in place to be electrically connected with conductive circuit traces on the first PCB. Pins 46 and 58 are inserted in a second PCB (not shown) and soldered in place to be electrically connected with conductive circuit traces of the second PCB. Connectors 12 and 38 are now assembled with one another to reach the mated connector assembly 10, thus providing signal and ground electrical continuity between the first and second PCBs.

Figure 3:
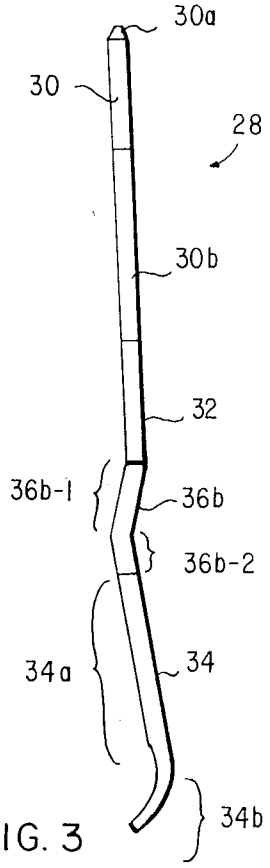
FIG. 3 is a right side elevation of the grounding contact member of FIG. 2.
Figure 2:
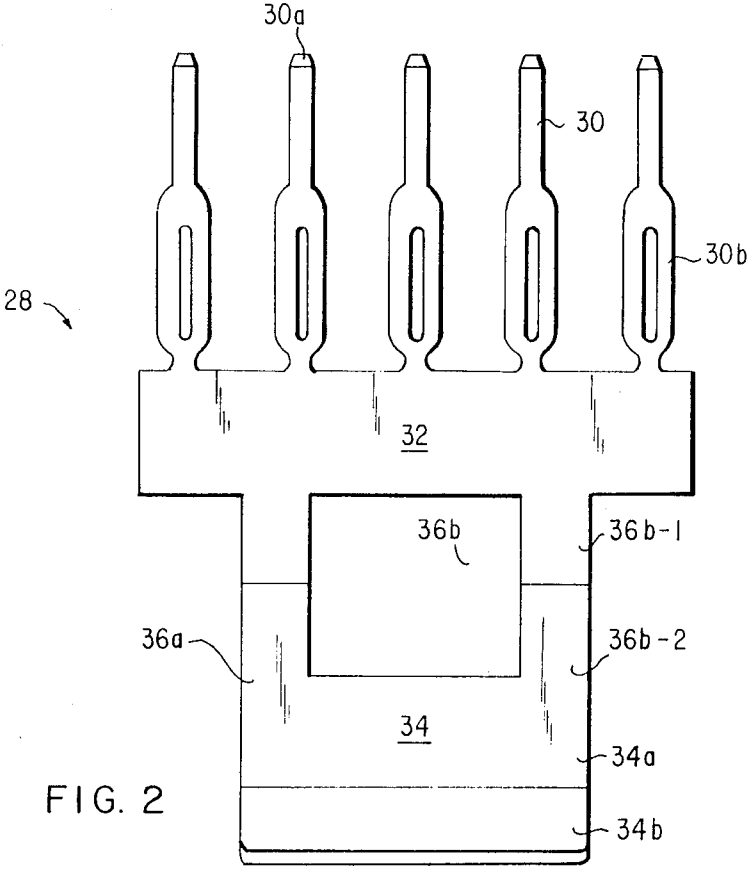
FIG. 2 is an elevational view of a grounding contact member preferably configured in accordance with the invention.

Turning to FIGS. 2 and 3, grounding contact member 28 has contacts 30 and shunt portion 32 aligned with one another. Legs 36*a* and 36*b* are commonly configured and FIG. 3 shows, for leg 36*b*, that it has a first part 36*b*—1 continuous with shunt portion 32 and a second part 36*b*—2 continuous with first part 36*a* and reversely tapered with respect thereto. Lower contact 34 has a first part 34*a* which is continuous with leg second part 36*b*, and follows the inclination thereof. Second part 34*b* of lower contact 34 is reversely bent as illustrated.

Figure 4:
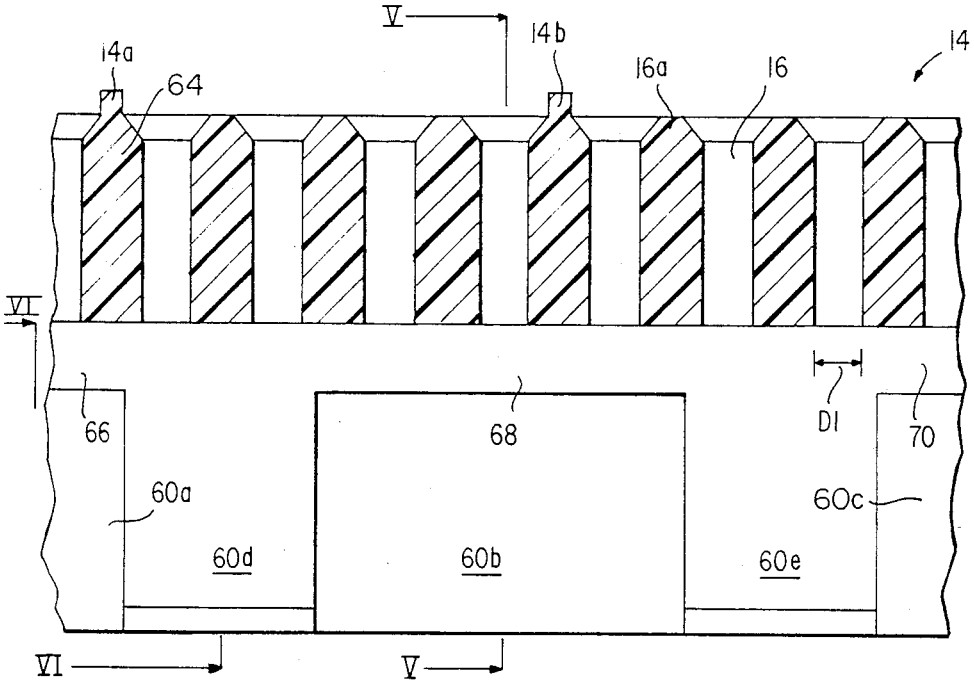
FIG. 4 is a partial sectional view of a connector housing in accordance with the invention as would be seen from plane IV—IV of FIG. 1.
Figure 5:
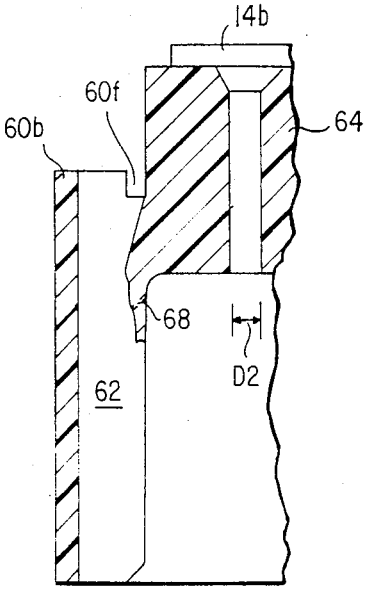
FIG. 5 is a partial sectional view as would be seen from plane V—V of FIG. 1 4.
Figure 6:
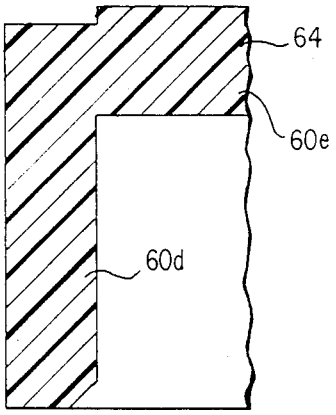
FIG. 6 is a partial sectional view as would be seen from plane VI—VI of FIG. 1 4.

The partial sectional view of FIG. 4 is taken from plane IV—IV of FIG. 1, looking in the direction of the arrows, and with the signal contacts 18 and grounding member 28 not resident in housing 14. The partial sectional view of FIG. 5 is taken from plane V—V of FIG. 4. The partial sectional view of FIG. 6 is taken from plane VI—VI of FIG. 4.

Signal contact seating passages 16 are seen as having one dimension D1 for the seating of the longer dimension of compliant sections 24 and a second, smaller dimension D2 for the seating of the shorter dimension of the compliant sections. As is well known in the connector art, such compliant sections are compressed in their dimension exceeding D1, thereby to frictionally engage the sidewalls of the seating passage and secure the contact in place. With the alternate contact design above discussed for solder usage, the swaged configuration of the contact is such that an interference occurs over dimension D1, which provides a retentive force to secure the contact in place. The seating passages are tapered as at 16*a* to facilitate signal contact insertion. Housing ribs 14*a* and 14*b* are provided to facilitate access of flux removal solvents soldering connector 12 to a PCB.

Wall 60 of housing 14, not shown in FIG. 1, would be located to the right of grounding contact member 28 in FIG. 1 and includes reduced thickness sections, three of which are seen as 60*a*, 60*b* and 60*c*, each permitting an individual grounding contact member 28 to be inserted in the housing. Thus, grounding contact member insertion channels are provided, as at 62 of FIG. 5. Each channel 62 is bounded sidewise by greater thickness sidewall sections 60*d* and 60*e* (FIG. 6), which have a notch 60*f* formed therein to assist in receiving the grounding contact members as discussed in connection with FIGS. 7 and 8 below. Housing base 64 has portions 66, 68 and 70 extending therefrom to an extent illustrated in FIG. 5. Base 64 and base portion 68 will be seen to have outer surface bounding channel 62 adjacent notch 60*f* which conforms with the attitudes of contact leg first and second parts 36*b*—1 and 36*b*—2 (FIG. 3).

Housing 14 will be seen to include a succession of greater and lesser thickness sections, each lesser thickness section having an upwardly extending base portion 66, 68 and 70 in facing registry therewith.

Figure 8:
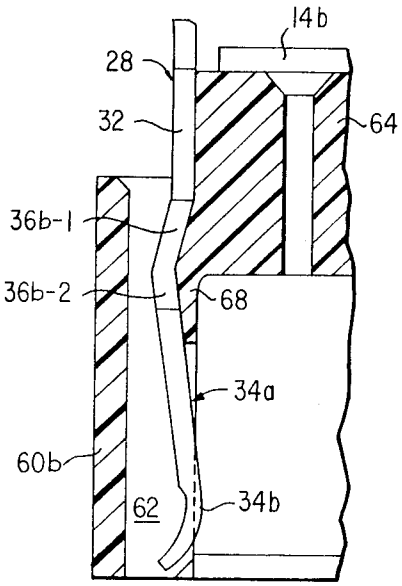
FIGS. 7 and 8 are repeat views of FIGS. 4 and 5 with the grounding contact member of FIGS. 2 and 3 assembled with the housing.
Figure 7:
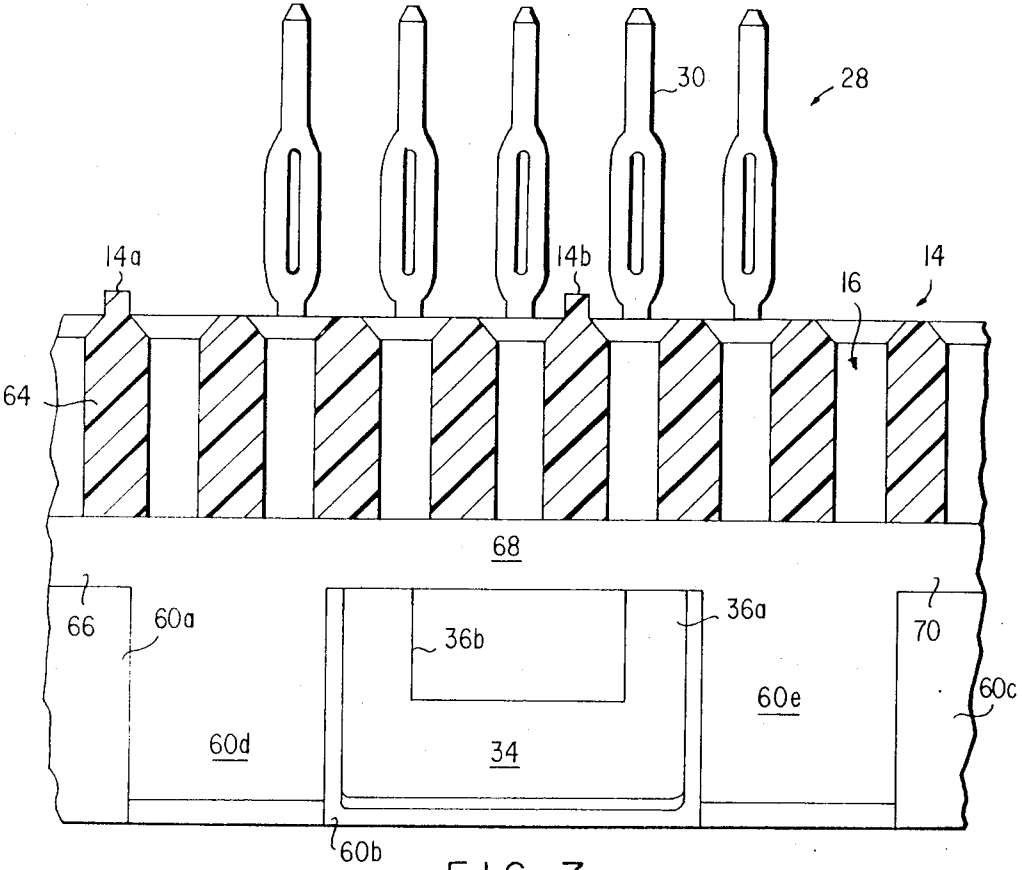

FIGS. 7 and 8 are repeat showings of FIGS. 4 and 5, however, with the grounding contact member 28 in place in housing 14. Shunt portion 32 of grounding contact member 28 is resident in notch 60*f*. The complemental interfit of base 64 and base portion 68 and first and second parts 36*b*—1 and 36*b*—2 of leg 36*b* is seen particularly in FIG. 8, serving to dispose contact 34 thereof with only its reversely bent end portion 34*b* in disposition to engage the grounding contact member, i.e., member 48, of mating connector 38 (FIG. 1).

Considering the contact disposition area of connector 12 to be the area to interiorly of reduced thickness housing sections 60*a*, 60*b* and 60*c*, connector structure in accordance with the invention includes base insulation, e.g., base portion 68, in such contact disposition area to effect the novel supporting of grounding contact member 28 by respective complementary configurations of the contact leg portions and the surfaces of base 64 and base portion 68.

Various changes may be introduced in the foregoing structure and modifications may be introduced in practice without departing from the invention. Thus, it is to be appreciated that the particularly depicted and described preferred embodiment and practice are intended in an illustrative and not in a limiting sense. The true spirit and scope of the invention are set forth in the following claims.

What is claimed is:

1. A connector for interconnecting first and second printed circuit boards, comprising:

(a) a first housing of electrically insulative material including a base and opposed first and second sidewalls defining a contact disposition area therebetween;

(b) a first contact set supported in said first housing contact disposition area, inclusive of a grounding contact member disposed adjacent said first sidewall and signal contacts disposed between said grounding contact member and said second sidewall, a portion of said base extending into said contact disposition area in juxtaposition partially co-extensively with said grounding contact member and disposed between said grounding contact member and said signal contacts;

(c) a second housing of electrically insulative material having configuration complemental with the configuration of said first housing to be matable therewith; and (d) a second contact set supported in said second housing including signal contacts engageable with the signal contacts of said first contact set upon mating of said first and second housings and a grounding contact member engageable with the ground contacts of said first contact set upon mating of said first and second housing.

2. The connector claimed in claim 1 wherein said first sidewall includes a reduced thickness portion in registry with said base portion and defining therewith a channel for the receipt of said grounding contact member.

3. The connector claimed in claim 2 wherein said grounding contact member is elongate and configured with longitudinally successive sections thereof having mutually different angled surfaces and wherein said base portion and said base are configured with sections having the same said mutually different surface angles.

4. The connector claimed in claim 3 wherein said first sidewall includes portions of thickness greater than said reduced thickness, such greater thickness portions being adjacent to said first sidewall reduced thickness portion and bounding said channel.

5. The connector claimed in claim 4 wherein said first sidewall greater thickness portions define notches for engagement with said grounding contact member.

6. The connector claimed in claim 1 wherein said grounding contact member includes a plurality of ground contacts, a shunt portion commoning said ground contacts, a further ground contact and legs interconnecting said further ground contact and said shunt portion.

7. A connector for interconnecting first and second printed circuit boards, comprising:

(a) a first housing of electrically insulative material including a base and opposed sidewalls defining a contact disposition area therebetween;

(b) a first contact set supported in said first housing contact disposition area, inclusive of a grounding contact member disposed adjacent one of said sidewalls and signal contacts disposed between said grounding contact member and the other of said sidewalls and having contact ends in said contact disposition area, a first portion of said base bounding said contact disposition area and defining a flat surface spaced from said ends of said signal contacts, a second portion of said base extending into said contact disposition area in juxtaposition partially co-extensively with said grounding contact member and disposed exteriorly of said flat surface and between said grounding contact member and said signal contacts;

(c) a second housing of electrically insulative material having configuration complemental with the configuration of said first housing to be matable therewith and having a flat surface for engagement with said base flat surface upon mating of said first and second housings; and (d) a second contact set supported in said second housing including signal contacts engageable with the signal contacts of said first contact set upon mating of said first and second housings and a grounding contact member engageable with said grounding contact member of said first contact set upon mating of said first and second housings.

* * * * *